United States Patent [19]

Johnson

[11] 4,064,855

[45] Dec. 27, 1977

[54] PRESSURE RELIEF AT FUEL INJECTION VALVE UPON TERMINATION OF INJECTION

[76] Inventor: Lloyd E. Johnson, 700 Highview Road, East Peoria, Ill. 61611

[21] Appl. No.: 658,252

[22] Filed: Feb. 17, 1976

[51] Int. Cl.[2] ..... F02M 51/06

[52] U.S. Cl. ..... 123/139 DP; 123/139 AF; 123/139 AT

[58] Field of Search ..... 123/DIG. 2, 139 AF, 123/139 E, 139 AT, 139 DP, 139 AA, 139 AV, 32 AE; 239/124, 126, 127

[56] References Cited

U.S. PATENT DOCUMENTS

| | | | |
|---|---|---|---|
| 1,613,000 | 1/1927 | Widdowson | 123/139 At |
| 3,587,547 | 6/1971 | Hussey et al. | 123/32 AE X |
| 3,837,324 | 9/1974 | Links | 123/32 AE X |
| 3,851,635 | 12/1974 | Murtin et al. | 123/139 E |
| 3,859,972 | 1/1975 | Watson et al. | 123/139 E |
| 3,880,131 | 4/1975 | Twaddell et al. | 123/139 E |

FOREIGN PATENT DOCUMENTS

| | | | |
|---|---|---|---|
| 233,035 | 10/1944 | Switzerland | 239/126 |

*Primary Examiner*—Charles J. Myhre
*Assistant Examiner*—Tony M. Argenbright
*Attorney, Agent, or Firm*—Darbo & Vandenburgh

[57] ABSTRACT

Immediately downstream of the high pressure fuel pump and electrical signal is generated by that part of the fuel pressure impulse intended to cause the fuel injection valve to close. That electrical signal energizes a solenoid causing the opening of a pressure relief valve incorporated into the valve body of the fuel injection valve. The relief valve is timed to open upon the closing of the fuel injection valve. In a multi-cylinder engine, the pressure relief valves for all cylinders are opened simultaneously. The pressure relief valves discharge into a pressure relief chamber, which may be individual for each valve or a common manifold communicating with the fuel supply.

19 Claims, 5 Drawing Figures

Fig. 2
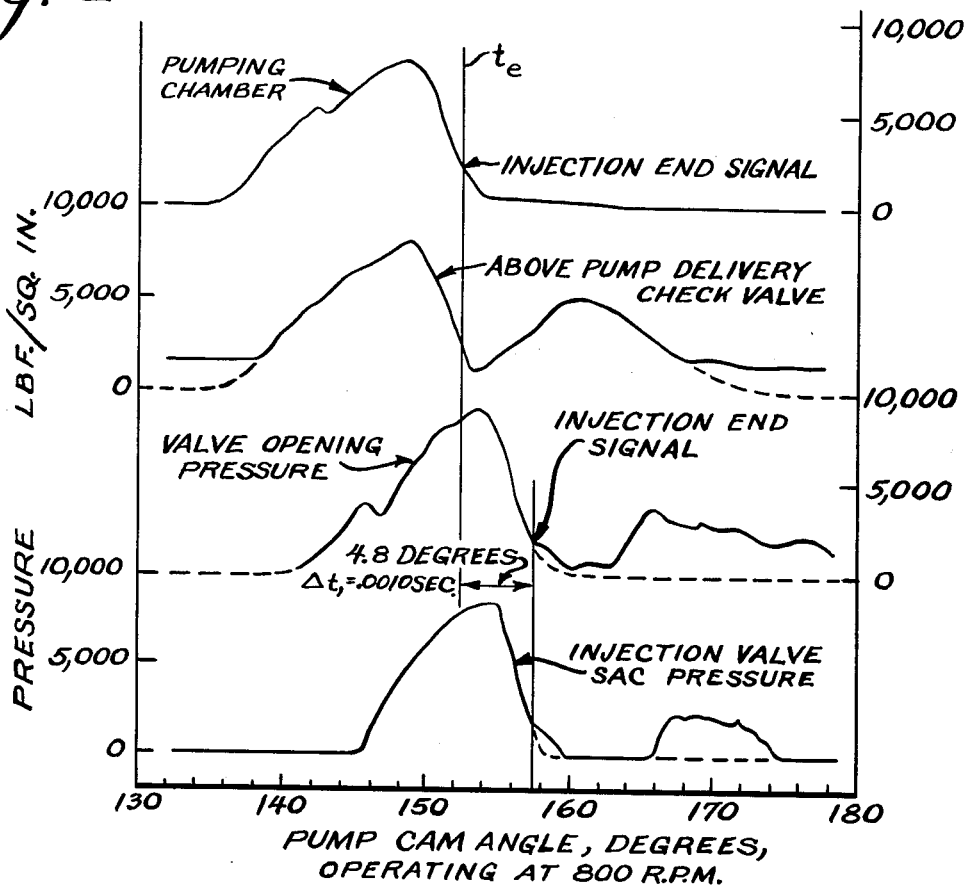
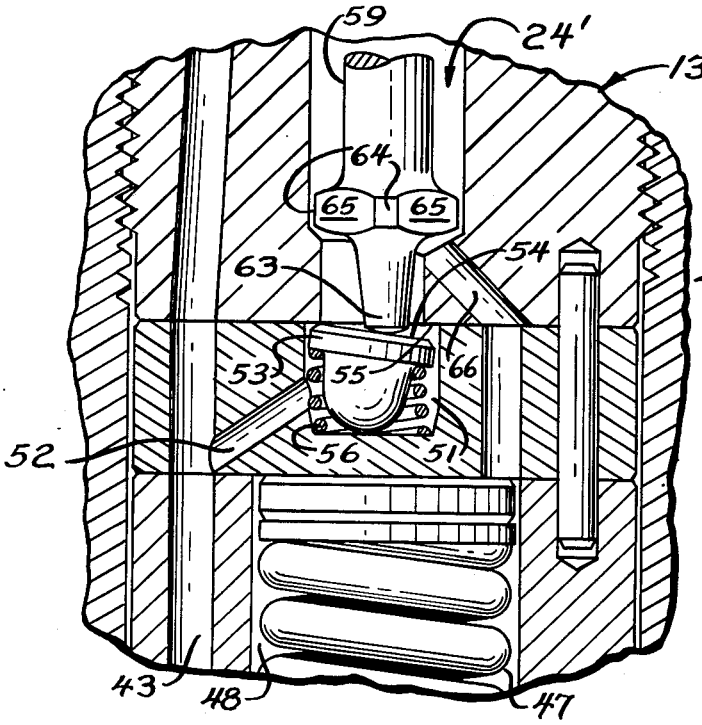
Fig. 4

PRESSURE RELIEF AT FUEL INJECTION VALVE UPON TERMINATION OF INJECTION

BACKGROUND AND SUMMARY OF THE INVENTION

While the present invention is primarily concerned with the injection of fuel into diesel engines, it could be employed in the fuel injection of other internal combustion engines. A common practice for the injection of fuel into the cylinder of a diesel engine is to use a fuel injection valve which substantially corresponds to a pressure relief valve. A high pressure fuel injection pump produces a pressure impulse in the fuel supply line for each cylinder. For a period of time determined by the characteristics designed into the engine, this pressure impulse causes the fuel injection valve to open and remain open while the fuel charge is being injected into the combustion chamber of the engine. As the pressure drops off at the end of the impulse it ultimately reaches a point at which it is no longer sufficient to hold the injection valve open, with the result that the valve closes shutting off the delivery of fuel.

Upon the drop in delivery pressure at the pump at the end of the pressure impulse a shock wave is produced in the fuel line upstream of the injection valve. The shock wave is caused by the inertia of the column of fuel that was moving just prior to the valve's subsequent closing, and may be likened to a shock wave that causes water hammer in a water pipe when a faucet is suddenly closed. Such a shock wave can be sufficient in strength as it reverberates through the length of the fuel supply line to overcome the closing force of the fuel injection valve and consequently cause that valve to briefly reopen. Of course when the fuel injection valve opens in response to such a spurious pressure injection signal, fuel is undesirably introduced into the combustion chamber. The injection of unwanted fuel into the combustion chamber obviously is wasteful. Furthermore, it may be injected at a time such that it is not adequately burned with the result of increasing pollution, etc.

In many diesel engines, a relatively high pressure is employed to open the fuel injection valve with the aim of improving the atomization of the fuel in the combustion chamber. Such pressures may be, for example, in the neighborhood of thirty-five hundred pounds per square inch. To the extent that higher pressures are employed, the more serious is the afterclosing shock waves in the fuel supply leading to the injection valve.

Thus, the principal object of the present invention is to eliminate the reopening of the valve in response to or spurious pressure impulses from the fuel supply lines communicating with the fuel injection valves. This goal is not a novel one, but my procedure for achieving the goal is novel. One prior art practice has been to incorporate a bleed valve into the fuel pump to open the conduit, which leads from the fuel pump to the fuel injection valve, to a by-pass line back to the fuel supply. This by-pass line may also have a pressure absorber connected thereto. See, for example, U.S. Pat. No. 3,587,547.

In the present invention, an electrically operated by-pass or relief valve actually located at the fuel injection valve is opened at the conclusion of the fuel injection impulse. Since this pressure relief valve is at the fuel injection valve end of the fuel supply passage, its opening provides a flow passage through which any such reflected pressure waves arriving at the fuel injection valve are diverted and dissipated to pressure levels insufficient to cause the reopening of the fuel injection valve. Such a relief valve can advantageously be incorporated into an electrically operated system for electronically controlling the fuel charge to the combustion chamber, but need not necessarily be.

In some embodiments of the invention, the relief or by-pass valves at all the injection valves open simultaneously into a common manifold. This ensures that all of the fuel injection valves have a common pressure when they are idle, i.e., the fuel injection pressure build-up starts from a common datum. The result is that uniform quantities of fuel are injected into each of the cylinders by each pressure pulse. If the starting pressures in each of the fuel injection valves are not uniform, i.e., they start from different datums, the quantity of fuel injected will likewise be unequal. This is, of course, an undesirable situation, but one that can occur.

Other objects and advantages will be apparent from the following description taken in conjunction with the drawings.

DESCRIPTION OF THE DRAWINGS

FIG. 2 is a series of graphs illustrating typical pressure pulses at different locations in the fuel supply conduit;

FIG. 4 is an enlarged illustration of the pressure relief valve portion of the embodiment of FIG. 3, with the relief valve open.

DESCRIPTION OF SPECIFIC EMBODIMENTS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 1:
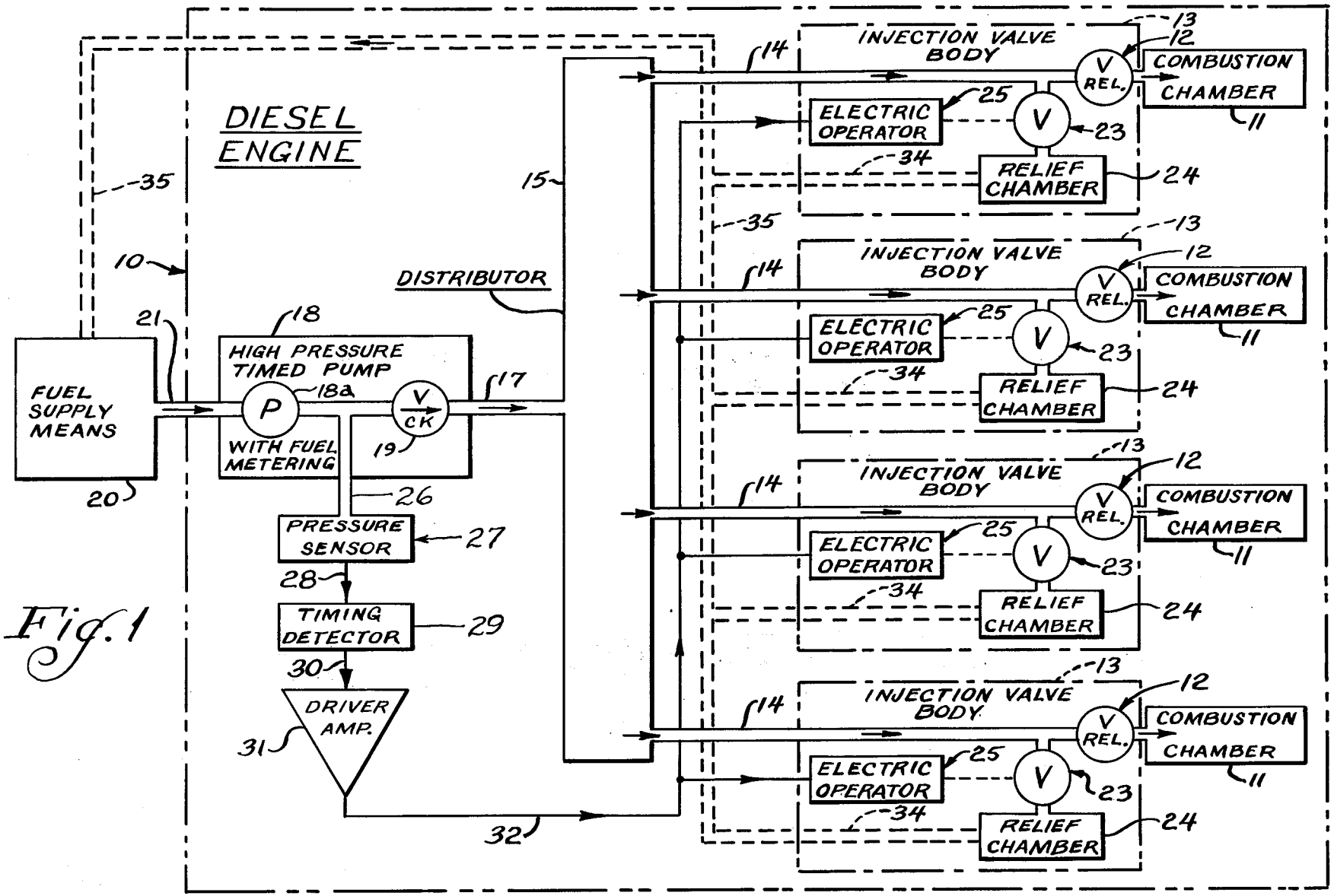
FIG. 1 is a schematic illustration of an engine embodying the present invention.

FIG. 1 illustrates diagrammatically a four-cylinder diesel engine, generally 10. Each of the cylinders has a combustion chamber 11. For the purpose of introducing fuel there is a fuel injection valve, generally 12, for each combustion chamber respectively. The injection valves are embodied in a valve body 13 which actually forms portions of the valve. Fuel is supplied to the valves through conduits 14 which communicate with a distributor 15. In turn, the fuel comes to the distributor through a conduit 17 from a high pressure pump 18. This pump produces pressure pulses in a pump chamber **18*a* and has a check valve 19 at the downstream end of the pump. The fuel supply means 20 which, for example, comprises a fuel tank and a low pressure pump delivers the fuel to the high pressure pump 18 through a conduit 21**.

The high pressure pump 18 produces a sequence of timed pulses of high pressure in the fuel in correlation to the operating speed of the engine. These pulses are directed to the respective fuel injection valves 12 in the predetermined sequence by distributor 15. The fuel injection valves correspond in operation to a pressure relief valve. When a high pressure pulse arrives at the valve it overcomes the spring loading of the valve to open the valve and cause fuel to be injected into the respective combustion chamber. As the pressure pulse dies off it no longer overcomes the closing force of the valve spring with the consequence that the spring then closes the valve.

As thus far described, the structure is representative of a conventional prior art diesel engine. The embodiment illustrated is one in which there is but a single high pressure pump 18 with the pulses therefrom being directed to the respective cylinders by distributor 15. Other types of engines employ a plurality of pumps, one for each cylinder respectively. From the following description it will be apparent that the present invention is equally applicable to such other engines. Also, for illustration purposes a diesel engine is used since the present invention is particularly applicable for solving problems existing in such an engine, but embodiments of the invention can be employed with advantage in other forms of internal combustion engines.

In the present invention, a relief or by-pass valve, generally 23, is associated with each of the fuel injection valves 12. Each relief valve has an intake opening which communicates with a supply conduit 14 immediately adjacent the respective injection valve. Each relief valve has a discharge opening which communicates with a relief chamber 24. The relief valves are normally closed and are opened by an electric operator, generally 25. The electric operators are formed by a solenoid and armature, not illustrated in FIG. 1.

A pressure sensor, generally 27, communicates with the fuel supply conduit immediately upstream of the pump check valve 19. This produces an electric signal in response to a selected value of the pressure of the fuel in the pressurized fuel supply conduit. As indicated by line 28, the electric signal from pressure sensor 27 is supplied to a timing detector 29. For the reasons hereinafter described, it is desired to initiate electric signals at about the end of each pressure pulse from pump 18. In other words, when the pressure pulse has decayed to a value at which the fuel injection valve 12 would close, an electric signal is required. Since that pressure value also occurs at the initiation of the pressure pulse, the purpose of the timing detector 29 is to distinguish between the two. This might be done for example by ascertaining that the pressure has been above the desired pressure magnitude for signal generation and then produce the output electrical signal only in response to the decay of that pressure pulse to the predetermined magnitude. Alternatively, it could react to the second of two occurrences of the preselected pressure provided those two occurrences were close together in time.

The electrical signal, when produced, is supplied to a driver amplifier 31 as indicated by line 30. The driver amplifier in turn supplies current momentarily through electric line (or wire) 32 to the solenoids of the electric operators 25. That current causes the electric operators to open relief valves 23 momentarily.

Due to the inertia of the mechanical components, there is an inherent time lag between the instant at which the electric signal or current is supplied to each of the operators 25 and the instant at which the valve 23 opens. Similarly, there is a time lag between the instant at which electric current to the operator 25 is discontinued and the instant at which the valve 23 closes. Also, the pressure pulse immediately adjacent pump 18 does not coincide exactly in phase with the pressure pulse at an injection valve 12 since in fuels for diesel engines, for example, the pulse will travel at about 4,200 feet per second. Advantageously, there is a delay in each instance which aids in achieving the desired result, which is that the by-pass valve 23 opens coincidentally with the arrival at the valve of the end of the pressure impulse to a pressure level sufficiently low as to cause closing of the injection valve 12 and remains open just long enough to dissipate any spurious, secondary pressure pulses in the fuel conduit 14. A duration of opening for the relief valve of about five milliseconds would be a typically adequate period for most high speed diesel engines currently being manufactured. By eliminating the secondary pulses the result is that the possibility of the injection valve 12 from being opened by those spurious pulses is also eliminated.

FIG. 2 illustrates the phase relationship between the pressure pulses occurring at various locations in the overall system. The curves depicted in solid lines are taken from FIG. 8, page 9, of a report "Diesel Fuel Injection System Simulation And Experimental Corrolation" by E. Benjamin Wylie et al, Society of Automotive Engineers, June, 1971, Preprint No. 710569; an investigation supported by U.S. Public Health Service Research Grant No. AP00835 from the National Air Pollution Control Administration. The top wave or trace indicates the pressure pulse as measured in the chamber 18*a* of the pump. The next to the top wave or trace depicts the pressure as measured above the pump delivery check valve, i.e., to the right of check valve 19 in FIG. 1. The next to the bottom wave or trace depicts the pressure acting on the fuel injection valve to open it (e.g., the pressure to the immediate left of the valve 12 in FIG. 1). The lowermost wave or trace illustrates the pressure as measured at the "sec" of the injection valve (e.g., at the immediate right of the injection valve 12 in FIG. 1).

It will be noted that it takes time for the pressure pulse to move from the pump to the injection valve; that is, the pressure pulse in the next to the bottom trace is farther to the right in the graph than it is in the topmost of the traces. As the pressure pulse drops off to a point relatively close to zero it reaches a value at which it is insufficient to overcome the strength of the spring of the injection valve with the result that the valve will close. This point is indicated by the notation "injection end signal" on both the first and third graphs. The solid line to the right of this point in the lowermost two traces illustrates the secondary pressure pulses that occur following the closing of the injection valve. The lowermost graph illustrates that this secondary pulse produces late injection of fuel into the combustion chamber. This is avoided in the present invention. In the present invention the relief valve 23 opens at the point of "injection end signal" whereupon the pressure at the injection valve drops off and remains at zero as depicted by the dashed line at the right side of the next to the bottom trace. The result is that there is no secondary injection of fuel as indicated by the dashed line at the right of the lowermost trace.

It will be noted that in the arrangement as thus described, all of the valves 23 are opened simultaneously, not just only the relief valve associated with the injection valve that has just been used but also the relief valves associated with the injection valves that have been dormant. This causes no problem so far as the systems associated with the dormant injection valves are concerned. As a matter of fact, it actually is an advantage in that the opening of communication between the conduit 14 and the respective relief chamber 24 a plurality of times during the period of dormancy tends to bring about the result that the dorment pressures in the various conduits 14 will be about equal. To the extent that they are equalized, the pressure pulse therein commences from a common datum thus resulting in the injection of corresponding amounts of fuel into each of the respective combustion chambers and consistent timing of the start of each such injection. To the extent that the datum in each conduit 14 varies, the result is a variance in the time delay before start of each injection cycle and a variance in the amount of fuel injected into the combustion chambers upon the occurrence of pressure pulses in the respective lines.

To ensure a common pressure datum in the various conduits 14, the pressure chambers 24 can be connected by conduits 34 to a common manifold 35. As illustrated in FIG. 1, manifold 35 may also communicate with the fuel supply means 20 (i.e., the fuel tank) so as to prevent any pressure accumulation in the manifold. With the relief chambers 24 all communicating with each other through manifold 35, and with the valves 23 opening simultaneously even when associated with dormant injection valves, the result is that a common pressure datum occurs in all of conduits 14.

To ensure that there is ample time for an electric operator 25 to open the respective relief valve 23 sufficiently long following the closing of the respective injection valve 12 to eliminate secondary pressure pulses, the pressure sensor 27 must communicate with the fuel system relatively close to the source of the pressure pulses, e.g., the pump chamber 18*a*. Thus considering the distance from the source of pressure pulses, i.e., pump chamber 18*a*, to an injection valve 12 as the overall or main fluid passage, the distance from the source of pressure pulses, to the sensor 27 must be relatively small (i.e., not over fifteen percent) as compared to that main fluid passage. This dictates that the branch conduit 26 should connect as closely as possible to the source of pressure pulses (chamber 18*a*) and should be relatively short in length. The inertia of the moving parts of the relief valve, and the inductive lag of the solenoid, can be varied to adjust the timing of the opening of the relief valve as required.

For effectively dampening the effect on the injection value of the secondary pulse which occurs when the pressure impluse ends, the respective relief valve should be within the last 15 percent (determined as in the preceding paragraph) of the overall fluid passage from the source of fluid pulses to the injection valve, i.e., the relief valve should be close to the injection valve with which it is associated. This positioning also can be important with regard to the problem of obtaining the proper timing between the time that the relief valve is open as related to the time that the fuel injection valve closes.

Figure 3:
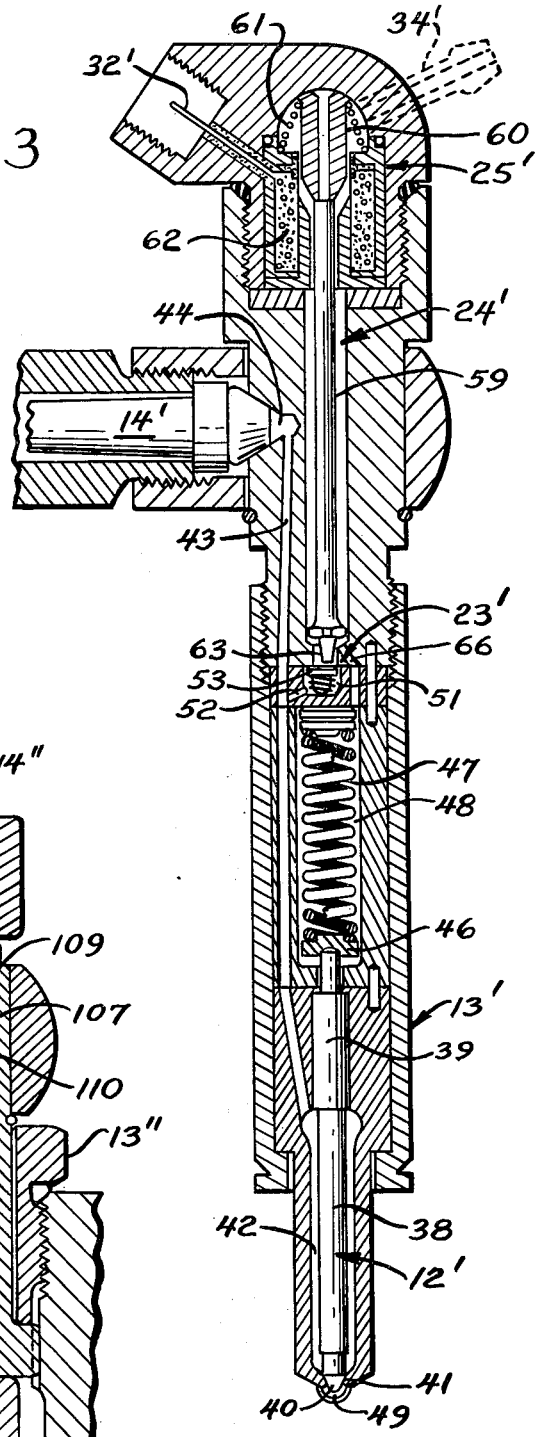
FIG. 3 is a section taken longitudinally through an inwardly opening fuel injection valve embodying the present invention.

FIG. 3 illustrates a conventional, inwardly opening diesel fuel injection valve which has been modified to incorporate a relief valve, valve operator and relief chamber in accordance with the present invention. Thus within the valve body 13' is a fuel injection valve 12', a relief valve 23', a relief chamber 24' and an electric operator 25'. The injection valve 12' comprises a plunger 38 having a piston portion 39 which is guided for axial movement in the valve body. One end of the plunger 38 is conical and forms a valve closure 40. The valve closure bears against a valve seat 41 formed by the valve body. Between the valve closure portion and the piston portion, the plunger 38 extends through a nozzle cavity 42. A passageway 43 extends through the valve body form the nozzle cavity 42 to a recess 44 in one side of the body. Recess 44 is in communication with fuel supply conduit 14'. Supply conduit 14' is secured by a suitable fitting of conventional design.

A pressure pad 46 bears against the other end of plunger 38 and transmits the valve closing force of spring 47 to the plunger. The spring 47, located in spring chamber 48, is in compression between pad 46 and the valve body 13'. Downstream of valve seat 41, the valve body 13' defines a sac 49 which is actually positioned in the combustion chamber (not depicted in FIG. 3). As thus far described, the fuel injection valve 12' is illustrative of the conventional valve. When a fuel pressure pulse occurs in nozzle cavity 42 it applies sufficient force to plunger 38 (particularly acting on piston portion 39) to overcome the force of spring 47 and move the valve closure 40 inwardly off of its seat 41. Thereupon fuel flows from the nozzle cavity 42 through sac 49 into the combustion chamber. When the pressure pulse drops off to an extent such that it no longer applies a force to plunger 38 sufficient to overcome the force of spring 47, the spring closes the valve by driving the closure 40 back onto its seat 41.

Valve body 13' also defines a valve chamber 51. Through a branch 52 passageway 43 communicates with valve chamber 51. A valve closure 53 is positioned in valve chamber 51 and has a face 54. Face 54 bears against an annular valve seat 55 and is urged against the seat by spring 56.

Within the opening that forms relief chamber 24' is a valve actuator 59. One end of the valve actuator is secured to an armature 60 which forms a part of the electric operator 25'. A coil spring 61 extends between the armature 60 and the body 13' to resiliently urge the armature away from solenoid 62 of the electric operator 25'. One end of solenoid 62 is grounded and the other end forms an electric connection 32'. Valve actuator 59 has a nose 63 to contact face 54 of the valve closure when the solenoid 62 is energized to thereby open the relief valve.

Adjacent nose 63 are four guide surfaces 64 to contact the walls of the body 13' surrounding chamber 24' and align the nose of the actuator with respect to the valve closure 53. In this respect it will be noted that the longitudinal axis of actuator 59 is offset (to the right in FIGS. 3 and 4) from the axis of closure 53 and its face 54. Intermediate guide surface 64 are flats 65. These provide space for fluid communication past this guide portion of the valve actuator. An angular passageway 66 provides fluid communication between relief chamber 24' and spring chamber 48. If a manifold 35 is to be employed as in FIG. 1, the conduit 34' is provided to communicate with relief chamber 24'.

When solenoid 62 is energized by the current from driver amplifier 31 the armature 60 is pulled in against the resistance of spring 61. This moves nose 63 against face 54 of the valve closure to open the valve in the manner illustrated in FIG. 4. The off-center relationship of the valve actuator 59 with respect to the valve closure 53 causes the valve closure to open primarily at one side as illustrated. This arrangement results in less force being necessary for the solenoid to open the valve.

Any late or spurious pressure wave that may then occur in passageway 23, which would otherwise tend to open valve 12', is released into relief chamber 24'. From relief chamber 24' that pressure wave is applied to the back side of piston portion 39 through passageway 66 and spring chamber 48. When so applied to the back side of piston portion 39, the pressure wave substantially cancels the effect of the pressure wave as applied in nozzle cavity 42 to the piston portion and thus allows spring 47 to hold valve 12' in the closed position. This procedure also can be employed to time the closing of the injection valve 12'; as for example, if the electric actuator 25' is energized before the "injection end signal" (FIG. 2) arrives at the injection valve 12', the opening of relief valve 23' applies an offsetting fluid force to the back side of piston portion 39 thus effectively canceling the fluid force applied to the front side of the piston portion (i.e., the "front" side being the side in nozzle cavity 42). This cancellation allows spring 47 to close valve 12'.

Figure 5:
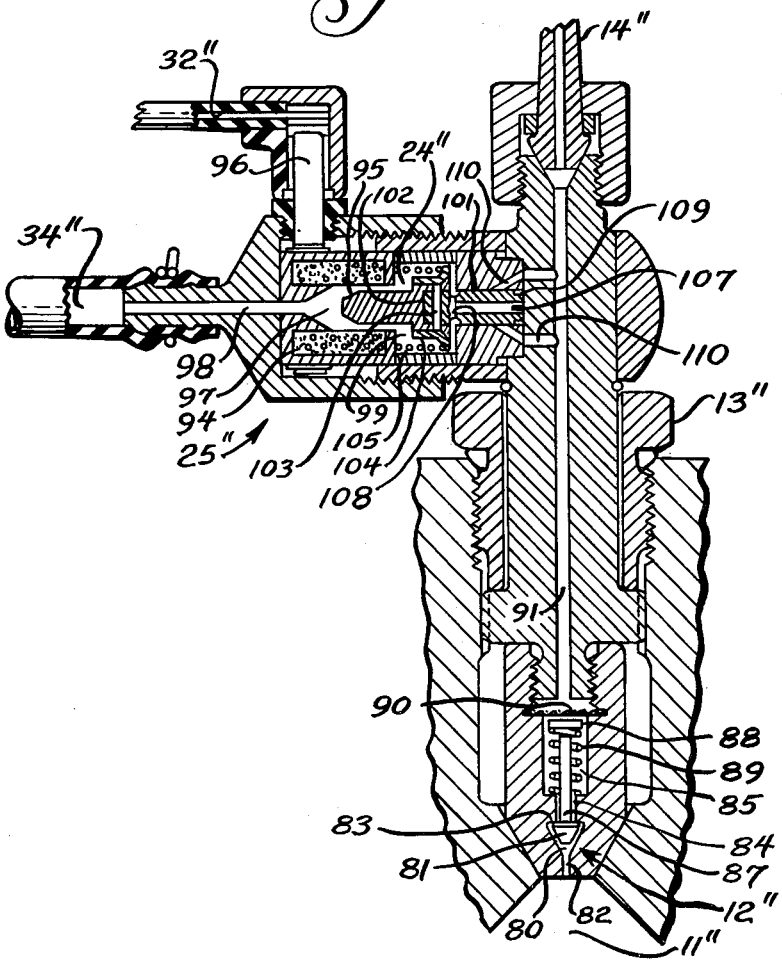
FIG. 5 is a longitudinal section through an outwardly opening fuel injection valve embodying the present invention.

FIG. 5 illustrates the present invention as applied to an outwardly opening fuel injection valve 12". The injection valve 12" is known per se, as for example, it substantially corresponds to that illustrated in U.S. Pat. No. ,2,560,799. The valve body 13" defines a valve sac 80 to receive valve closure 81. An orifice 82 extends from sac 80 to the combustion chamber 11". The valve closure 81 bears against an annular valve seat 83. The valve seat surrounds one end of an opening 84 which extends between valve sac 80 and spring chamber 85.

A valve stem 87, which is integral with valve closure 81, extends through opening 84 and spring chamber 85. The valve stem has a head 88 on the other end thereof. The valve closing spring 89 is in compression between head 88 and valve body 13". A filter 90 extends across an intermediate part of chamber 85. A passageway 91 communicates between chamber 85 and fuel supply conduit 14".

When a pressure impulse is applied to fuel conduit 14"it applies pressure to head 88 and part of valve closure 81 to create a force acting in valve opening direction in opposition to the force applied by spring 89. This causes the valve closure to move off seat 83 to allow fuel to enter combustion chamber 11" through orifice 82. When the pressure impulse subsides, that valve opening force is no longer sufficient to overcome the action of spring 89, whereupon the spring again takes over and closes the valve 12".

The electric operator 25" comprises a solenoid 94 and an armature 95. One end of the solenoid is grounded and the other end is connected to a terminal 96. Terminal 96 is used to obtain an electrical connection to wire 32". The solenoid defines an armature chamber 97 which communicates through a passageway 98 with conduit 34". Armature chamber 97 is an extension of a valve chamber 99.

The valve closure 101 is cylindrical in configuration and is closely fitted in a cylindrical opening in the body. The valve closure has a head 102 which is secured by a pin 103 to armature 95. An annular retainer 104 is locked to armature 95 and covers the ends of pin 103 so as to hold the pin in place. Also, the retainer forms an abutment for the valve closing spring 105 which is in compression between that abutment and the end of the immovable solenoid. Valve closure 101 has an axial passageway 107, and cross passageways 108 communicating from the axial passageway to the valve chamber 99. The opposite end of valve closure 101 has an external relief 109. Angular passageways 110 extend from fuel supply passageway 91 to the opening within which the valve closure 101 is received.

When the solenoid 94 is energized, it pulls armature 95 to the left in FIG. 5. This results in a corresponding movement of valve closure 101. The relief 109 on the end of the valve closure clears passageways 110 thereby permitting fluid communication through the passageways 110 thereby permitting fluid communication through the passageways 110 between the fuel supply passageway 91 in the valve body 13" and the axial passageway 107 in the valve closure 101. This then permits pressure impulses which may occur in the passageway 91 to be dissipated through chambers 97, 99, and passageway 98 to the relief conduit 34". It will be apparent that the chambers 97, 99 can (in their present form or in an enlarged form) act as a relief chamber 24 in the event that it is not desired to use conduit 34" to communicate with a manifold 35. Upon solenoid 94 being deenergized, spring 105 returns the valve closure to the position illustrated in FIG. 5. In this position, the valve closure 101 blocks angular passageways 110 and thereby shuts off the fluid communication between the axial passageway 107 in the valve closure and the fuel supply passageway 91 in the valve body 13".

From the foregoing those skilled in the art will be aware of other embodiments that may be constructed for particular engines. The embodiments discussed were merely illustrative. For example, either of the relief valve embodiments described could be used with an inwardly opening fuel injection valve or either could be used with an outwardly opening fuel injection valve.

I claim:

1. In a fuel injection apparatus for an internal combustion engine having a combustion chamber, said apparatus including a fuel injection valve having a downstream side through which fuel is injected into said chamber and an upstream side, fuel pulse supply means connected to said upstream side for supplying metered and timed pulses of fuel to said valve for injection into said chamber, said pulses each having a start and an end, the improvement comprising:

a normally closed relief valve having an intake opening communicating with the upstream side of the injection valve and a discharge opening;

power means connected to the relief valve for opening the relief valve to permit communication between the intake and discharge openings in timed relationship to arrival at the injection valve of said ends of pulses of fuel flow; and means communicating with said discharge openings to receive fuel that may flow from the intake to the discharge openings when the relief valve is open.

2. In an apparatus as set forth in claim 1, wherein said power means includes a solenoid and armature for actuating said relief valve, and sensor means connected to the fuel pulse supply means for producing electric signals in timed relation to the fuel pulses and connected to said solenoid for the electric signals to energize the solenoid and open the relief valve.

3. In an apparatus as set forth in claim 2, wherein said fuel pulse supply means includes pump means for generating said fuel pulses with the opening of the injection valve being in response to a pressure increase point of the pulse and the closed being in response to a predetermined pressure decrease point of the pulse, the further improvement comprising:

said sensor means having a fluid input and an electric output, said sensor means being responsive to a part of the pulse following said pressure increase point to initiate the electric signal, said input of said sensor means being connected immediately adjacent said pump means, whereby said electric signal is initiated sufficiently early with respect to the pulse to accommodate the inertia time lag in the opening of the relief valve by the power means.

4. In an apparatus as set forth in claim 3 and wherein the fuel injection valve includes a valve closure, spring means acting on the valve closure in valve closing direction, a valve piston journaled in said body, and having a front side and a back side, said front side being exposed to said pressure pulses whereupon in response to a pressure pulse said piston acts on said valve closure in opposition to said spring means to unseat said valve closure for said injection of fuel into said chamber, the further improvement comprising:

means communicating with said discharge opening and said back side of said piston for applying to the back side of the piston the fluid pressure existing at said discharge opening, whereby when the relief valve is open the fluid pressure at said sides of said piston will equilibrate and said spring means will not have significant opposition in the moving of said valve closure to the valve closed position.

5. In an apparatus as set forth in claim 2 for use with an engine having a plurality of combustion chambers with the apparatus including a fuel injection valve for each of said chambers, said fuel supply means including a distributor communicating with each injection valve to supply said pulses of fuel to the valves individually, the improvement comprising:

an additional number of relief valves corresponding to said normally closed relief valve, said number being such that there is one relief valve for each of said injection valves respectively, said relief valves being connected downstream of the distributor;

said power means being connected to each of said relief valves;

said fuel receiving means communicating with the discharge openings of each relief valve; and said sensor means has a fluid input and an electric output.

6. In an apparatus as set forth in claim 5, wherein each of said power means includes a respective solenoid and armature for actuating the respective relief valve, said solenoids being connected in parallel whereby all of said relief valves are opened simultaneously.

7. In an apparatus as set forth in claim 6, wherein said means communicating with said discharge openings includes a manifold in communication with all of the discharge openings whereby pressure in the supply means to each of the various injection valves is equalized by the simultaneous opening of the relief valves.

8. In an apparatus as set forth in claim 6, wherein said fuel pulse supply means includes pump means and fuel passage means between the pump means and the fuel injection valves, the further improvement comprising:

said relief valve communicating with the fuel passage means within the last fifteen percent of its total length from the pump means.

9. In an apparatus as set forth in claim 5, wherein said fuel pulse supply means includes a pump chamber within which the pulses originate and fuel passage means between the pump chamber and the fuel injection valves, the further improvement comprising:

the connection of the sensor means to the fuel pulse supply means being such that the distance from the pump chamber to the sensor means is not over fifteen percent of the distance from the pump chamber to the fuel injection valves.

10. In an apparatus as set forth in claim 2, wherein the relief valve includes a valve seat defining a discharge opening about an axis, a valve closure having a face positioned against said seat and closing said opening, means resiliently urging the valve closure against the seat and a valve actuator positioned to contact said face at a location offset from said axis and movable through said opening to displace the closure from said seat, said valve actuator being connected to said armature to be so moved when said solenoid is energized, whereby said offset contact tends to displace one side of the face more with respect to the seat than it does the opposite side.

11. In an apparatus as set forth in claim 1, wherein said fuel pulse supply means includes pump means and fuel passage means between the pump means and the fuel injection valves, the further improvement comprising:

said relief valve communicating with the fuel passage means within the last 15 percent of its total length from the pump means.

12. In an apparatus as set forth in claim 1 for use with an engine having a plurality of combustion chambers with the apparatus including a fuel injection valve for each of said chambers, said fuel supply means including a distributor communicating with each valve to supply said pulses of fuel to the valves individually, the improvement comprising:

an additional number of relief valves corresponding to said normally closed relief valve, said number being such that there is one relief valve for each of said injection valves respectively, said relief valves being connected downstream of the distributor;

said power means being connected to each of said relief valves;

said fuel receiving means communicating with the discharge openings of each relief valve; and said power means opening all of said relief valves simultaneously.

13. In an apparatus as set forth in claim 12, wherein said means communicating with said discharge openings includes a manifold in communicating with all of the discharge openings whereby pressures between the upstream sides of the various injection valves are equalized by the simultaneous opening of the relief valves.

14. In an apparatus as set forth in claim 13, wherein the relief valve includes a valve seat defining a discharge opening about an axis, a valve closure having a face positioned against said seat and closing said opening, means resiliently urging the valve closure against the seat and a valve actuator positioned to contact said face at a location offset from said axis and movable through said opening to displace the closure from said seat, whereby offset contact tends to displace one side of the face more with respect to the seat than it does the opposite side.

15. In an apparatus as set forth in claim 1 and wherein the fuel injection valve includes a valve closure, spring means acting on the valve closure in valve closing direction, a valve piston journaled in said body, and having a front side and a back side, said front side being exposed to said pressure pulses whereupon in response to a pressure pulse said piston acts on said valve closure in opposition to said spring means to unseat said valve closure for said injection of fuel into said chamber, the further improvement comprising:

means communicating with said discharge opening and said back side of said piston for applying to the back side of the piston the fluid pressure existing at said discharge opening, whereby when the relief valve is open the fluid pressure at said sides of said piston will equilibrate and said spring means will not have significant opposition in the moving of said valve closure to the valve closed position.

16. In the method of injecting fuel into the combustion chamber of an internal combustion engine wherein a series of pressure impulses are produced in the fuel supply line in timed relationship, each impulse acting to open a check valve and permit a slug of fuel to be introduced into said chamber, the improvement comprising:

sensing the existence of at least part of said impulse at a location upstream of said valve and producing a control signal thereupon;

releasing into a low pressure area the fuel pressure immediately upstream of the check valve in response to said control signal.

17. In the method of claim 16 employed with an engine having a plurality of combustion chambers with a check valve for each of said chambers, the further improvement comprising:

simultaneously releasing into low pressure areas the fuel pressure immediately upstream of all the check valves in response to said control signal.

18. In the method of claim 17 including returning the fuel released into all of said areas to the fuel supply for the engine.

19. In the method of claim 16 and wherein the check valve includes a piston which is acted upon in valve opening direction by said pulses to cause the piston to open the valve for the injection of the pulses into the combustion chamber, the further improvement comprising:

applying the fluid pressure released into said low pressure area to said piston in valve closing direction.

* * * * *

UNITED STATES PATENT AND TRADEMARK OFFICE

CERTIFICATE OF CORRECTION

PATENT NO. : 4,064,855

DATED : December 27, 1977

INVENTOR(S) : Lloyd E. Johnson

It is certified that error appears in the above-identified patent and that said Letters Patent are hereby corrected as shown below:

Abstract, line 2, "and" should read --an--.
Column 1, line 51, delete "or".
Column 4, line 35, "'sec'" should read --"sac"--.
Column 5, line 4, "dorment" should read --dormant--.
Column 5, line 47, "value" should read --valve--.
Column 6, line 4, "form" should read --from--.
Column 6, line 50, "surface" should read --surfaces--.
Column 7, line 22, delete the comma before "2,560,799".
Column 8, lines 6-7, delete "thereby permitting fluid communication through the passageways 110".
Column 8, line 62, "closed" should read --closing--.
Column 10, line 44, "communicating" should read --communication--.

Signed and Sealed this

*Thirtieth* Day of *May 1978*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,064,855

DATED : December 27, 1977

INVENTOR(S) : Lloyd E. Johnson

It is certified that error appears in the above-identified patent and that said Letters Patent are hereby corrected as shown below:

Column 8, line 67, "increase" should read --decrease--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*